United States Patent [19]

Hara

[11] Patent Number: 4,967,896

[45] Date of Patent: Nov. 6, 1990

[54] CONTROL ARRANGEMENT FOR AUTOMATIC VENDING MACHINE

[75] Inventor: Seiji Hara, Saitama, Japan

[73] Assignees: Tokyo Sanyo Electric Co., Ltd., Gunma; Sanyo Electric Co., Ltd., Osaka, both of Japan

[21] Appl. No.: 210,196

[22] Filed: Jun. 20, 1988

Related U.S. Application Data

[63] Continuation of Ser. No. 707,605, Mar. 4, 1985, abandoned.

[51] Int. Cl.[5] ..... G07F 9/08

[52] U.S. Cl. ..... 194/217; 221/2; 453/2; 364/479

[58] Field of Search ..... 194/217, 218; 364/479, 364/464; 221/2; 453/1, 2

[56] References Cited

U.S. PATENT DOCUMENTS

| | | | |
|---|---|---|---|
| 3,321,058 | 5/1967 | Brooks | 194/2 |
| 3,368,570 | 2/1968 | Nagy et al. | 133/2 |
| 3,820,642 | 6/1974 | Levasseur | 194/1 N |
| 3,948,377 | 4/1976 | Hayashi et al. | 133/2 X |
| 3,963,035 | 6/1976 | Levasseur | 133/2 |
| 4,056,181 | 11/1977 | Ikeguchi et al. . | |
| 4,126,147 | 11/1978 | Brisebarre et al. | 133/2 X |
| 4,185,646 | 1/1980 | Woods et al. | 364/479 X |
| 4,231,105 | 10/1980 | Schuller et al. | 364/479 X |
| 4,361,161 | 11/1982 | Johnson | 133/2 X |
| 4,381,835 | 5/1983 | Shah et al. | 194/1 N |
| 4,706,202 | 11/1987 | Kobayashi et al. | 194/217 X |

FOREIGN PATENT DOCUMENTS

| | | | |
|---|---|---|---|
| 0133495 | 11/1978 | Japan | 194/1 N |
| 0068299 | 6/1979 | Japan | 194/1 N |

*Primary Examiner*—Kevin P. Shaver
*Assistant Examiner*—Edward S. Ammeen
*Attorney, Agent, or Firm*—Birch, Stewart, Kolasch & Birch

[57] ABSTRACT

A control arrangement for an automatic vending machine includes a price memory device for preliminarily storing selling prices of commodities, a coin signal output section for outputting coin signals upon insertion of coils, a sum calculating device for calculating a sum of inserted coins in response to the coin signals, a difference calculating device for calculating a difference between the sum of the inserted coins and the selling price, a device for calculating the required number of coins for change by dividing the difference by the sum of coins of the same denomination, and a device for judging vendibility at the selling price based on whether or not the required number of coins for the change is present. In this way, the vendibility of all commodities may be determined according to their selling prices without successively subtracting the value of change to paid out for each increment of selling price, and prior to the actual vending of the commodity.

3 Claims, 8 Drawing Sheets

FIG. 4

6 REGISTER BANK

| | |
|---|---|
| INSERTED 5¢ COIN No. REGISTER | CNC 5 |
| INSERTED 10¢ COIN No. REGISTER | CNC 10 |
| INSERTED 25¢ COIN No. REGISTER | CNC 25 |
| INSERTED 50¢ COIN No. REGISTER | CNC 50 |
| INSERTED 1 $ COIN No. REGISTER | CNC 1 $ |
| INSERTED SUM REGISTER | TC |
| INSERTED SUM BUFFER 1 | TC BUF |
| INSERTED SUM BUFFER 2 | TCD BUF |
| PAYABLE 5¢ COIN No. REGISTER | CNCP 5 |
| PAYABLE 10¢ COIN No. REGISTER | CNCP10 |
| PAYABLE 25¢ COIN No. REGISTER | CNCP25 |
| PAYABLE 50¢ COIN No. REGISTER | CNCP50 |
| PAYABLE 1 $ COIN No. REGISTER | CNCP1$ |
| COIN PRESENT/ABSENT DATA REGISTER | ESTRG |
| VENDIBILITY DATA REGISTER 1 | SEF 1 |
| VENDIBILITY DATA REGISTER 2 | SEF 2 |
| TABLE POINT REGISTER | R6 |
| FLAG | FLG |

FIG. 5(a)

| ADDRESS | TABLE DATA |
|---|---|
| TBL 1+1 | MASK DATA "01" |
| TBL 1+2 | MASK DATA "02" |
| TBL 1+3 | MASK DATA "04" |
| TBL 1+4 | MASK DATA "08" |
| TBL 1+5 | MASK DATA "10" |
| TBL 2+1 | JUMP ADDRESS TO SUB-ROUTINE SBST 5 |
| TBL 2+2 | JUMP ADDRESS TO SUB-ROUTINE SBST 10 |
| TBL 2+3 | JUMP ADDRESS TO SUB-ROUTINE SBST 25 |
| TBL 2+4 | JUMP ADDRESS TO SUB-ROUTINE SBST 50 |
| TBL 2+5 | JUMP ADDRESS TO SUB-ROUTINE SBST 1$ |
| TBL 3+1 | JUMP ADDRESS TO SUB-ROUTINE TBND 5 |
| TBL 3+2 | JUMP ADDRESS TO SUB-ROUTINE TBND 10 |
| TBL 3+3 | JUMP ADDRESS TO SUB-ROUTINE TBND 25 |
| TBL 3+4 | JUMP ADDRESS TO SUB-ROUTINE TBND 50 |
| TBL 3+5 | JUMP ADDRESS TO SUB-ROUTINE TBND 1$ |
| TBL 4+1 | ADDRESS OF REGISTER CNC 5 |
| TBL 4+2 | ADDRESS OF REGISTER CNC 10 |
| TBL 4+3 | ADDRESS OF REGISTER CNC 25 |
| TBL 4+4 | ADDRESS OF REGISTER CNC 50 |
| TBL 4+5 | ADDRESS OF REGISTER CNC 1$ |

FIG. 5(b)

| ADDRESS | TABLE DATA |
|---|---|
| TBL 5+1 | ADDRESS OF REGISTER CNCP 5 |
| TBL 5+2 | ADDRESS OF REGISTER CNCP 10 |
| TBL 5+3 | ADDRESS OF REGISTER CNCP 25 |
| TBL 5+4 | ADDRESS OF REGISTER CNCP 50 |
| TBL 5+5 | ADDRESS OF REGISTER CNCP 1$ |
| TBL 6+1 | 5¢ PAYABLE MAX. COIN No. DATA "10" |
| TBL 6+2 | 10¢ PAYABLE MAX. COIN No. DATA "10" |
| TBL 6+3 | 25¢ PAYABLE MAX. COIN No. DATA "10" |
| TBL 6+4 | 50¢ PAYABLE MAX. COIN No. DATA "01" |
| TBL 6+5 | 1 $ PAYABLE MAX. COIN No. DATA "01" |

| | |
|---|---|
| TBL 1 | LEADING ADDRESS FOR TABLE 1 |
| TBL 2 | LEADING ADDRESS FOR TABLE 2 |
| TBL 3 | LEADING ADDRESS FOR TABLE 3 |
| TBL 4 | LEADING ADDRESS FOR TABLE 4 |
| TBL 5 | LEADING ADDRESS FOR TABLE 5 |
| TBL 6 | LEADING ADDRESS FOR TABLE 6 |

FIG. 5(c)

CONTROL ARRANGEMENT FOR AUTOMATIC VENDING MACHINE

This application is a continuation of application Ser. No. 707,605, filed on Mar. 4, 1985, now abandoned.

BACKGROUND OF THE INVENTION

The present invention generally relates to an automatic vending system and more particularly, to a control arrangement for an automatic vending machine, which determines whether or not an article or commodity can be vended by an amount or sum of coins inserted by a customer.

In the case where the sum or amount of coins inserted by the customer is equal to the selling price for the commodity, it is clear that such a commodity is vendible, but if the sum of the inserted coins exceeds the selling price, it is necessary to determine the vendibility of said commodity by detecting whether or not a difference therebetween can be paid out as change. Coins which may be paid out as change include two sorts of coins, i.e., those preliminarily stored in a change coin stocking section and those inserted by the customer at that time for purchasing, and thus, a decision must be made for judging whether or not a difference between the sum of the inserted coins and the selling price of the commodity can be paid out as change, by finding the difference based on the combination of the two sorts of coins as referred to above.

Conventionally, there has been disclosed, for example, in U.S. Pat. No. 4,056,181, an automatic vending machine of the above described type. In the above prior art, it is so arranged that the number of coins inserted by a customer is calculated according to the kinds thereof, while the coin detectors for detecting presence or absence of change in the change coin reservoirs are provided so as to judge whether or not the difference between the sum of inserted coins and the selling price may be paid out as the change, based on the number of inserted coins and the detecting outputs of the coin detectors. The above known system includes a subtractor for sequentially subtracting the smallest unit value from the sum of coins inserted by the customer, so that in the case where the remaining sum after the subtraction can be paid out by the coins accommodated in the change coin reservoir, or where no change is present in the change coin reservoir and the remaining sum can be paid out within the number of inserted coins, it is so judged that vending is possible with respect to the selling price which requires the remaining sum to be paid out as change during the vending. In this prior art, however, owing to the arrangement that the smallest unit value is sequentially subtracted from the sum of inserted coins, the vendibility is to be judged with respect to all prices within the sum of the inserted coins. Accordingly, since the vendibility is determined with respect to prices not included in the selling price, the processing time for the judgment is undesirably prolonged. Moreover, the processing itself for subtracting each of the smallest unit values from the sum of inserted coins, has the disadvantage that the processing time becomes long as the sum of the inserted coins increases.

SUMMARY OF THE INVENTION

Accordingly, an essential object of the present invention is to provide an improved control arrangement for an automatic vending machine, which is capable of determining vendibility more quickly and positively than in conventional arrangements.

Another important object of the present invention is to provide a control arrangement for an automatic vending machine of the above described type, in which coins inserted by a customer at that time are effectively utilized as change to be paid out.

A further object of the present invention is to provide a control arrangement for an automatic vending machine of the above described type, which is capable of accurately determining vendibility even under a coin system including various kinds of coins having values in a relation of integer multiples with respect to a 10 cent coin at a small value, as in a 25 cent coin in the U.S.A. and Canada.

A still further object of the present invention is to provide a control arrangement for an automatic vending machine of the above described type, which is simple in construction and stable in functioning at high reliability, and can be readily incorporated into various automatic vending machines at low cost.

In accomplishing these and other objects, according to one aspect of the present invention, it is so arranged that the vendibility is determined by directly calculating a difference between the sum of inserted coins and the selling price for finding the vendibility so as to judge whether or not the difference can be paid out as change. Therefore, according to the present invention, such an inconvenience as determining the vendibility with respect to prices which are not set as the selling prices within the sum of inserted coins will be eliminated.

In another aspect of the present invention, the vendibility is determined in such a manner that the difference between the sum of inserted coins and the selling price for finding the vendibility is divided by the sum of coins for the kind of change so as to calculate the number of coins necessary for paying out of change, thereby judging whether or not said necessary number of coins can be paid out. Therefore, according to this invention, a high speed processing may be achieved, since the calculation is effected through division.

In still another aspect of the present invention, the arrangement is so made to determine the vendibility, that the number of coins inserted by a customer at that time is calculated for comparison between the number of inserted coins and the number of coins required for paying out the change, with respect to the same kind of coins.

According to one preferred embodiment of the present invention, it is so arranged that, when a change coin reservoir stores change coins more than the predetermined number so as to be in the state for presence of change, the change coins equivalent to said predetermined number can be paid out as the change at the maximum, and therefore, the change coins possessed by the change coin reservoir may be effectively discharged as the change.

Moreover, according to the embodiment of the present invention, in the case where the change coin reservoir stores change coins more than the predetermined number and is in the state of presence of change, the total number of coins of said predetermined number and the number of coins of the same kind inserted by the customer at that time, is set to be the number of coins which can be paid out.

BRIEF DESCRIPTION OF THE DRAWINGS

These and other objects and features of the present invention will become apparent from the following description taken in conjunction with the preferred embodiment thereof with reference to the accompanying drawings, in which:

FIG. 4 is a diagram of a register bank which is included in a central processing unit in the circuit construction of FIG. 3;

FIGS. 5(*a*), 5(*b*) and 5(*c*) are diagrams showing respective tables programmed in a read only memory in the circuit construction of FIG. 3.

DETAILED DESCRIPTION OF THE INVENTION

Figure 1:
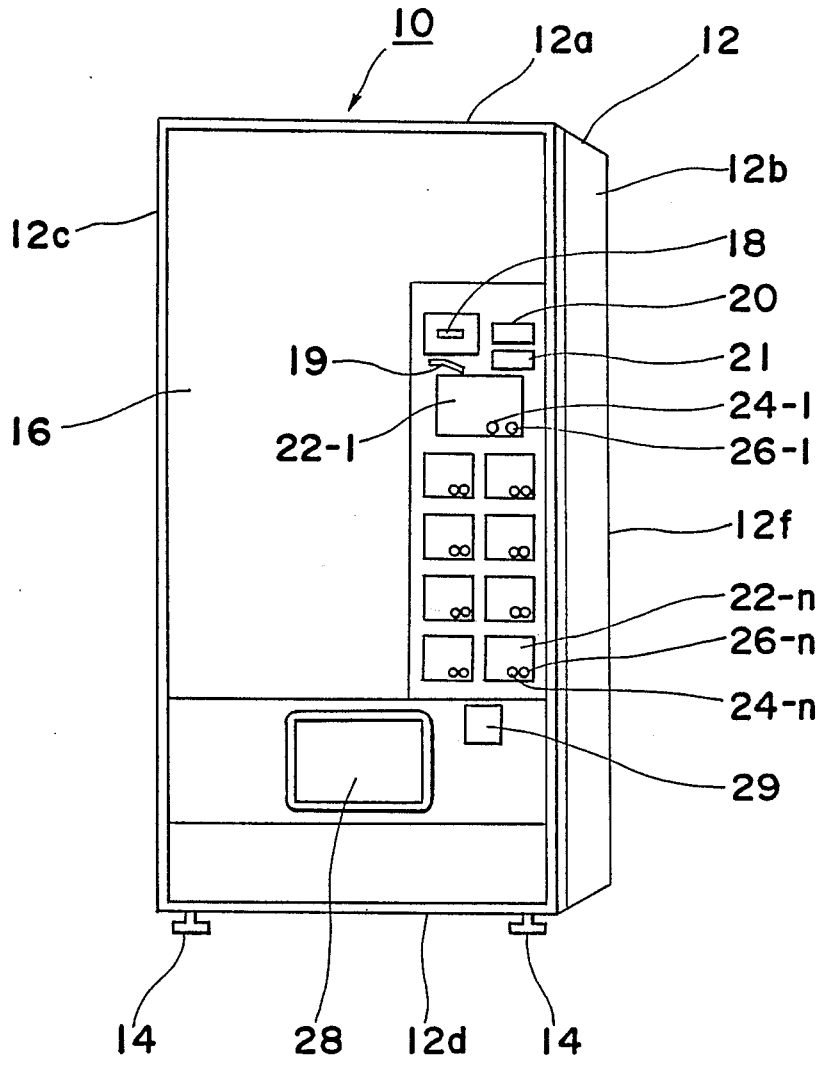
FIG. 1 is an overall perspective view of an automatic vending machine to which a control arrangement according to one preferred embodiment of the present invention is applied.

Before the description of the present invention proceeds, it is to be noted that like parts are designated by like reference numerals throughout the accompanying drawings.

Referring now to the drawings, there is shown in FIG. 1 an automatic vending machine 10 to which a control arrangement according to one preferred embodiment of the present invention is applied. It is to be noted here that, although the automatic vending machine 10 for the present embodiment is intended to deal with a plurality of articles and/or commodities, the concept of the present invention is not limited in its application to the vending machine dealing with such articles and/or commodities alone, but may also be applied to automatic vending machines dealing with other items such as servicing, information, etc.

In FIG. 1, the automatic vending machine 10 generally includes a housing 12, for example, in a cubic box-like configuration constituted by a top wall 12*a*, side walls 12*b* and 12*c*, a bottom wall 12*d* and a rear wall 12*f*, and open at its front side, where a servicing panel 16 for customers is hingedly supported at one side for selective opening or closing of the housing 12, with a plurality of adjustable legs 14 being provided under the bottom wall 12*d* of the housing 12 for installation of the vending machine 10.

The servicing panel 16 is provided with a coin inserting slit 18 capable of receiving 5 cent coins, 10 cent coins, 25 cent coins, 50 cent coins and also 1 dollar coins. It is to be noted here that the servicing panel 16 may also be provided with another slit (not shown) for paper money in association with the slit 18 so that dollar notes, etc. may be accepted therethrough, but the description hereinafter will be limited to the case of coins alone.

The above servicing panel 16 is further provided with a coin return switch 19 having a lever in a position, for example, below the coin inserting slit 18 for returning the coins inserted through the slit 18. At the right side of the slit 18 in FIG. 1, there is provided a sum indicator 20, for example, in the form of a digital indicator capable of displaying numerical values in four digits, so as to be utilized for indicating the total sum and/or inserted sum of the coins inserted through the coin inserting slit 18. Below and adjacent to this sum indicator 20, a change runout indicator 21 is provided, and displays a comment, for example, "correct change only", when the 5 cent coins, 10 cent coins, etc. in stock to be paid out as the change have become short or run out.

The servicing panel 16 is also provided with a plurality of selection switches 22-*l*, . . . 22-*n*, and therefore, this automatic vending machine 10 is capable of selling items in n pieces, while at corresponding positions of the respective selection switches 22-*l*, . . . 22-*n*, there are provided "vendible" indicators 24-*l*, . . . 24-*n*, and "sold-out" indicators 26-*l*, . . . 26-*n*. The "vendible" indicators 24-*l*, . . . 24-*n* are each constituted, for example, by lamps, light emitting diodes, etc. so as to indicate that the items selected by the associated selection switches are vendible. The "vendible" indications relate to the case where the sum of the inserted coins is equal to the price of the commodity or where said sum is higher than said price, and a difference therebetween at that time can be paid out as the change, and the present invention discloses the judgment on the vendibility at such case.

Meanwhile, the "sold-out" indicators 26-*l*, . . . 26-*n* similarly constituted by lamps, light emitting diodes, etc. are adapted to indicate that the items selected by the associated selection switches are in the "sold-out" state.

At the lower portion of the servicing panel 16, there is formed a discharge port 28 so as to allow vended commodities to be taken out therefrom. At the upper right side of said discharge port 28, a coin pay-out port 29 is formed, into which inserted coins are returned upon actuation of the coin return switch 19 and change coins are discharged.

Figure 2:
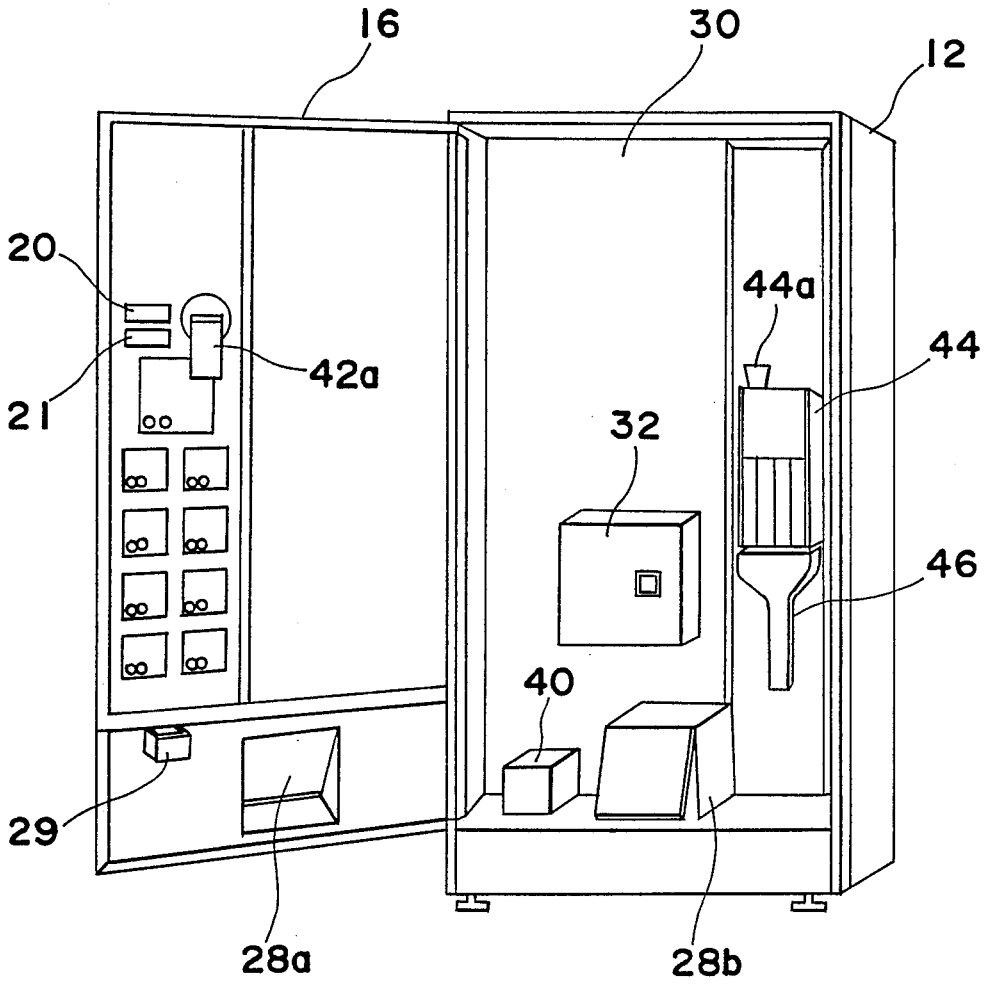
FIG. 2 is a view similar to FIG. 1, which particularly shows a customer service panel thereof in an opened state.

Referring also to FIG. 2 showing the vending machine 10, with its servicing panel 16 opened, another inner door 30 is further provided within the housing 12 for selective opening and closing thereof. At the front face of this inner door 30, there is mounted a control box 32, in which electronic components necessary for controlling, such as a central processing unit, etc. to be explained later, are accommodated.

Under the control box 32 in the housing 12, a power source 40 is disposed for supplying DC power or AC power to the control box 32 and other necessary portions.

At the back of the servicing panel 16 in a position associated with the coin inserting slit 18, there is attached, for example, a hollow and cylindrical coin chute 42*a*, the lower end of which is adapted to correspond to a hopper 44*a* of a coin mechanism 44 provided in the housing 12, upon closing of the servicing panel 16. The coin mechanism 44 as referred to above includes a coin selector which switches according to the kinds of coins inserted, and when the switch is closed one time by a coin selected by the coin selector, a coin signal indicating that one coin of the equivalent kind was inserted is fed to the control box 32. The coin mechanism 44 further includes coin stockers (not particularly shown) for storing coins for the change according to the kinds thereof. In each of the coin stockers corresponding to 5 cent coins, 10 cent coins, and 25 cent coins, coin detectors for detecting the presence or absence of coins based on whether or not more than 10 coins are accommodated therein, are respectively provided. Upon selection by the coin selectors, the inserted coins are introduced into the corresponding coin stockers according to the kinds thereof. The coin mechanism 44 is provided with changers (not shown) under the coin stockers, and under said changers, further provided with a coin chute 46 for leading the coins paid out from the coin stocker through the changer or the returned coins, into the coin pay-out port 29. Although commodity stock sections equal in number to the selection switches 22-*l*, . . . 22-*n* are formed in the housing 12 behind the inner door 30, detailed description thereof is omitted here for brevity, since they are not directly related to the present invention. The servicing panel 16 is formed with an opening 28*a* communicated with the discharge port 28 as shown in FIG. 1, while on the lower portion of the inner door 30, there is provided a connection chute 28*b* for leading the commodities delivered from the commodity stock sections into the discharge port 28.

Figure 3:
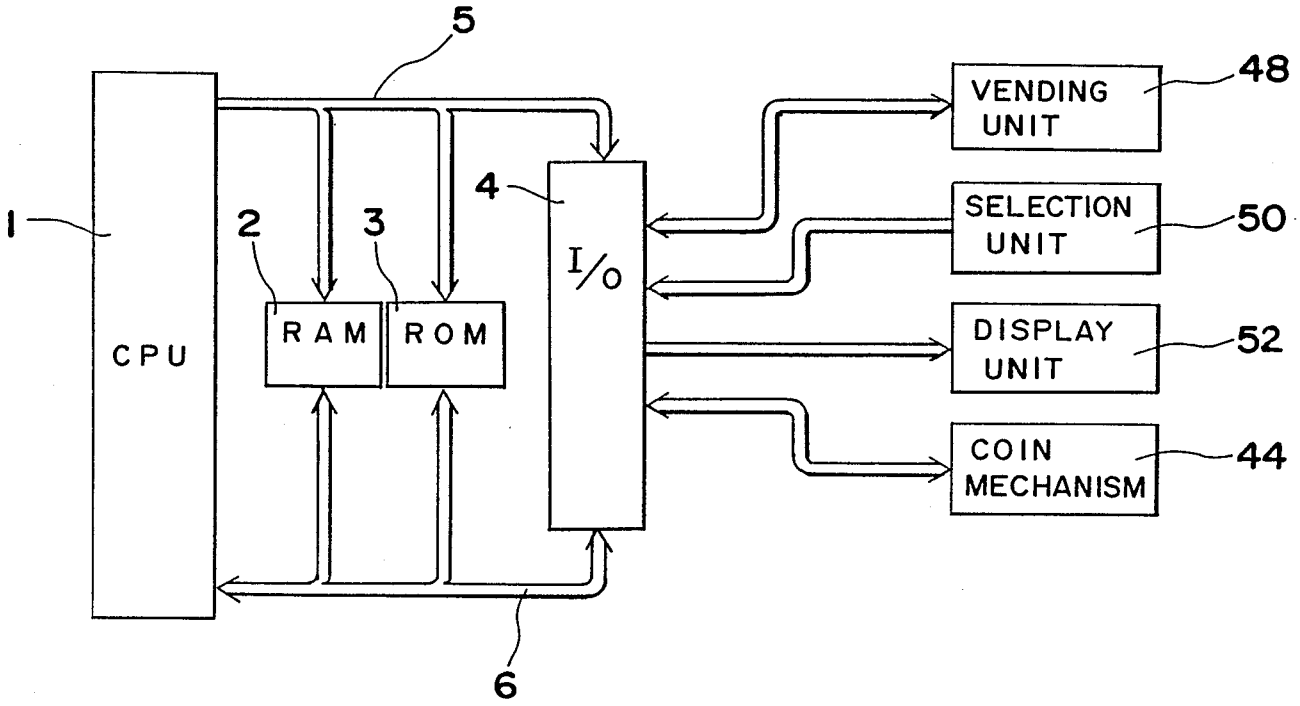
FIG. 3 is a block diagram showing an electrical circuit construction for the control arrangement according to the present invention.

Referring to FIG. 3, there is shown an electrical circuit construction for a control arrangement according to one preferred embodiment of the present invention, which generally includes a CPU (central processing unit) 1, a RAM (random access memory) 2, a ROM (read only memory) 3, and an I/O (input/output) interface 4, all of which are connected to each other by an address bus 5 and a data bus 6 as shown, while a vending unit 48, a selection unit 50, a display unit 52 and the coin mechanism 44 are further coupled to the I/O interface 4 as illustrated.

For the CPU 1, for example, a model "8039" (name used in trade and manufactured by Intel Corporation of U.S.A.) may be employed, and for the RAM 2, for example, a model "TC5517" (name used in trade and manufactured by Toshiba Co., Ltd., Japan) can be adopted. For the ROM 3, for example, a model "2764" (name used in trade and manufactured by Intel Corporation of U.S.A.) may be used, while for the I/O interface 4, for example, a model "M5L8243" (name used in trade and manufactured by Mitsubishi Electric Corporation, Japan) may be employed.

The vending unit 48 connected to the I/O interface 4 is provided in association with the commodity stock sections referred to earlier, and effects the commodity feeding out function under the control of the CPU 1.

The selection unit 50 including the selection switches 22-*l*, . . . 22-*n* (FIG. 1) applies a signal indicating that the selection switch is actuated to the CPU 1 via the I/O interface 4.

The display unit 52 includes the sum indicator 20, a change run-out indicator 21, "vendible" indicators 24-*l*, . . . 24-*n*, and "sold-out" indicators 26-*l*, . . . 26-*n* described earlier, and is controlled by the CPU 1 through the I/O interface 4.

The coin mechanism 44 applies the coin signals and signals produced in the coin detectors and indicating presence or absence of coins in the coin stockers as referred to earlier, to the CPU 1 via the I/O interface 4, while the CPU 1 applies a signal for paying out necessary coins to the coin mechanism 44 through the I/O interface 4. The CPU 1 calculates the sum of inserted coins and the number of inserted coins according to the kinds of coins by the coin signals, but the number of the inserted coins is to be maintained over one vending period by a particular customer at that time. Accordingly, although the inserted coins are mechanically introduced into the coin stockers, they are treated separately from the coins stored in the coin stockers, for the calculation during that vending period.

The CPU 1 includes a register bank 6 as shown in FIG. 4, in which there are formed registers CNC5, CNC10, CNC25, CNC50 and CNC1$ for respectively storing the number of coins inserted by the customer according to respective coins for 5¢, 10¢, 25¢, 50¢ and $1.00, and also a register TC for storing the sum of the inserted coins and buffer registers TCBUF and TCDBUF for the sum of the inserted coins. The CPU 1 is arranged to calculate the sum of inserted coins based on the inserted coin signal applied thereto through the I/O interface 4 from the coin mechanism 44 upon insertion of the coins, for loading into the register TC. In the register bank 6, there are also formed registers CNCP5, CNCP10, CNCP25, CNCP50 and CNCP1$ for storing the number of coins which can be paid out as change according to the respective kinds of coins 5¢, 10¢, 25¢, 50¢ and $1.00. The CPU 1 determines the number of coins which can be paid out according to the respective kinds of coins based on the presence or absence of coins stored in the coin stockers and the number of coins inserted by the particular customer at that time. Also formed in the register bank 6 is a register ETSRG in which there are stored coin presence/absence data indicating presence or absence of stored coins for the respective coin stockers corresponding to the coin kinds of 5¢, 10¢, 25¢, 50¢ and $1.00. Such coin presence/absence data are loaded into the register ETSRG by representing the presence or absence of coins according to the respective kinds of coins as "1" or "0" of one bit. In the register bank 6, there are also formed registers SEF1 and SEF2 in which vendible/not vendible data indicating vendibility according to the kinds of commodities are stored. The vendible/not vendible data are loaded into the registers SEF1 and SEF2 by representing the possibility or impossibility of vending according to the respective kinds of commodities as "1" or "0" of one bit. The register bank 6 further includes a table-point register R6 for reference to tables programmed in the ROM 3, and a flag set register FLG.

Although not particularly shown, selling prices according to the respective kinds of commodities are stored in the RAM 2. For the input of the selling prices, there has been proposed a method in which the input is effected by scanning bar code sheets representing the selling prices with a bar code reader, and since an input apparatus of this kind is disclosed in U.S. patent application Ser. No. 592,410 Pat. No. 4,608,487, entitled "An Input Unit of an Automatic Vending Machine", filed on Mar. 23, 1984 and assigned to the same assignee as in the present invention, this input unit is hereby incorporated by reference for explanation of the present invention. Meanwhile, as another input apparatus, a keyboard device is well known.

In the ROM 3, seven kinds of table data respectively having addresses TBL1 to TBL6 as leading addresses are programmed as data together with control procedures of the automatic vending machine as shown in FIG. 5. In the addresses from the address (TBL1+1) to the address (TBL1+5), there are programmed mask bit data to be use when the coin presence/absence data for the respective coin stockers are read off from the register ESTRG, and in the addresses from the address (TBL2+1) to the address (TBL2+5), data of respective jump addresses for sub-routines SBST5, SBST10, SBST25, SBST50 and SBST1$ are programmed. In the addresses from the address (TBL3+1) to the address (TBL3+5), data of respective jump addresses for subroutines TBND5, TBND10, TBND25, TBND50 and TBND1$ are programmed, while in the addresses from the address (TBL4+1) to the address (TBL4+5), there are programmed data of addresses with respect to the respective registers CNC5, CNC10, CNC25, CNC50 and CNC1$ corresponding to the respective coin kinds of the register bank 6. In the addresses from the address (TBL5+1) to the address (TBL5+5), there are programmed data of addresses with respect to the respective registers CNCP5, CNCP10, CNCP25, CNCP50 and CNCP1$ corresponding to the respective coin kinds of the register bank 6. In the addresses from the address (TBL6+1) to the address (TBL6+5), there are programmed the maximum number of coins which may be paid out, in the case where coins are present in the coin stockers corresponding to the respective coins for 5¢, 10¢, 25¢, 50¢ and $1.00.

Figure 6A:
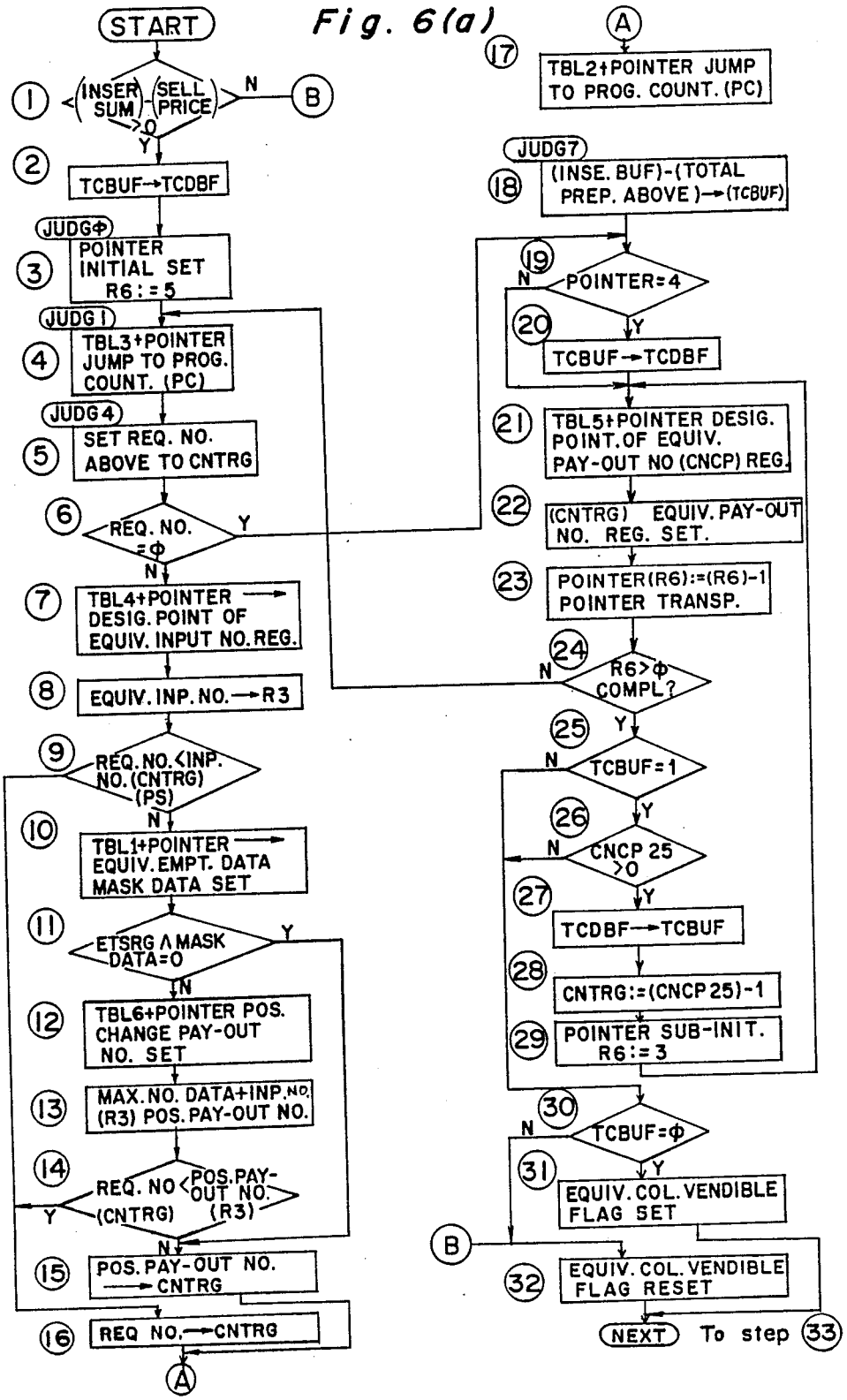
FIGS. 6(*a*) and 6(*b*) are flow-charts explanatory of functions of the control arrangement according to the present invention (FIG. 6(*a*) continues onto FIG. 6(*b*)).
Figure 6B:
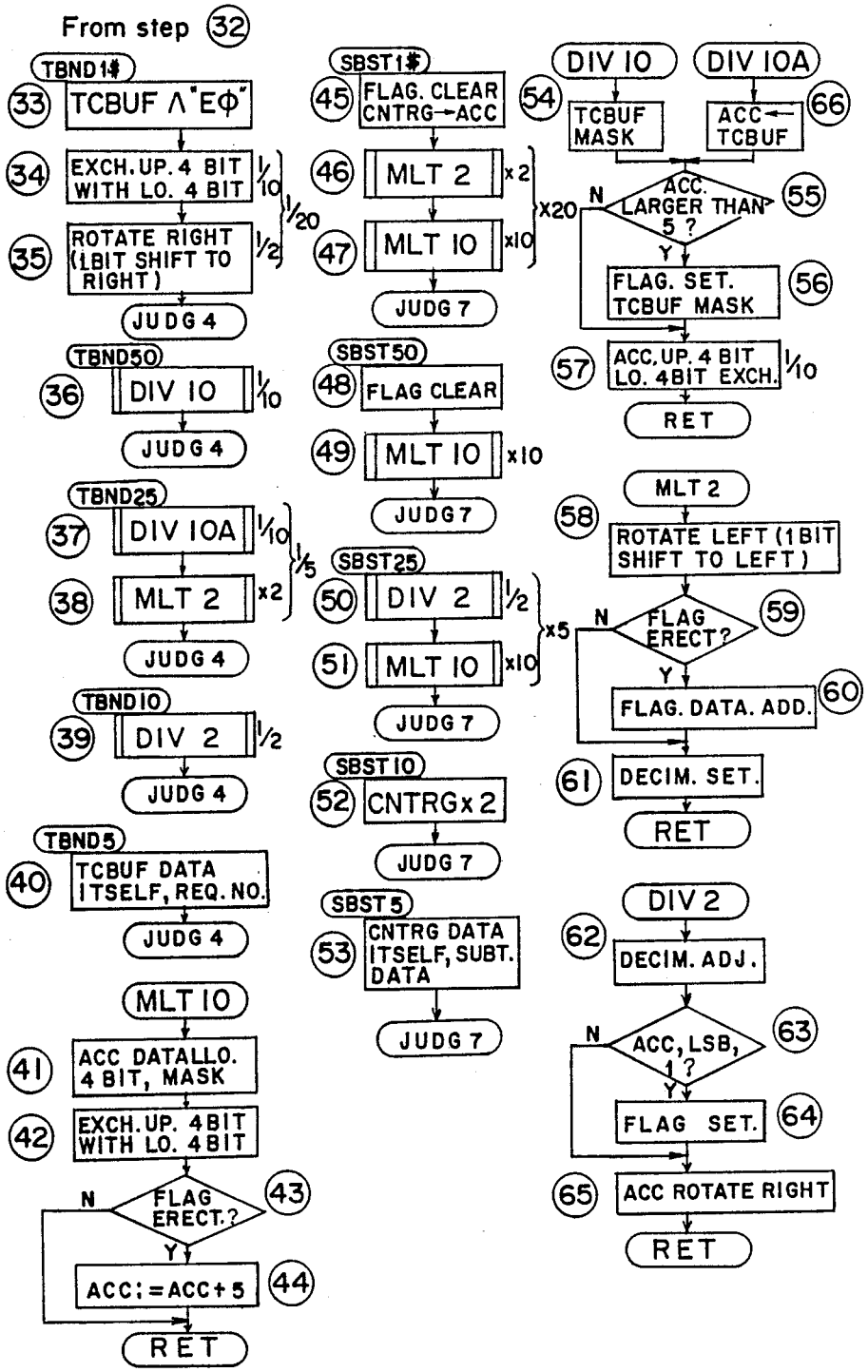

Referring now to the flow-chart of FIGS. 6(*a*) and 6(*b*), the process of judgment of the vendibility by the CPU 1 according to the present invention will be explained hereinbelow with reference to a specific example.

Now, it is assumed that a $1.00 coin, a 50¢ coin, a 25¢ coin, a 10¢ coin and a 5¢ coin are inserted, one by one, by a customer and the sum of the coins thus inserted amounts to 1 dollar and 90 cents. In this example, for calculation of the sum, 5¢ is represented by "01" as one unit, and therefore, $1.00 is denoted by "20". Accordingly, by the above insertion of coins amount to 1 dollar and 90 cents, "38" is stored in the register TC. Meanwhile, "1" is stored as the number of inserted coins in the respective registers CNC5, CNC10, CNC25, CNC50 and CNC1$. In the above case, the conditions for presence or absence of coins in the respective coin stockers are so set that coins are absent for 1 dollar, 50 cents and 10 cents, but are present for 25 cents and 5 cents. Accordingly, in the register ESTRG, data "00000011" in eight bits, with first and third bits of "1" respectively, are stored.

Subsequently, judgment of the vendibility with respect to a commodity at a selling price of 45 cents will be described. In this case, 45 cents is subtracted from the sum of the inserted coins and judgment is made as to whether or not the remainder of 1 dollar and 45 cents can be paid out for the determination of the vendibility, the outline of which process will be first explained hereinbelow.

In the first place, 1 dollar and 45 cents is divided by one dollar to render the calculated value "1" as the required number of one dollar coins. The required number of one dollar coins may be paid out by the number of one dollar coins inserted, and the remaining 45 cents is calculated by subtracting one dollar from 1 dollar and 45 cents. Then, the remaining 45 cents is divided by 50 cents, but in this case, the required number of coins is "0" since the calculated value is smaller than "0", and successively, the remaining 45 cents is divided by 25 cents. In the above case, the calculated value "1" is the required number of 25¢ coins, which can be paid out according to the number of inserted 25: coins, and thus, 25 cents is subtracted from 45 cents to calculate the remaining 20 cents. When the remaining 20 cents is divided by 10 cents, the required number of 10 cent coins, which is "2", is obtained. Since the number of inserted 10 cent coins is only one and no coins are present in the coin stocker for 10 cents, the number of 10 cent coins which can be paid out is one. Accordingly, the value for one 10 cent coin is subtracted from the remaining 20 cents. The remaining 10 cents is divided by 5 cents to calculate the necessary number "2". Although the number of the inserted 5 cent coins is one, since coins are present in the coin stocker for 5 cents, the number thereof which may be paid out is eleven in total which is the sum of ten 5 cent coins, which is the maximum number to be paid out, and the inserted one 5 cent coin. Accordingly, since the required number "2" of the 5 cent coins can be paid out, values for two 5 cent coins are subtracted from the remaining 10 cents, and thus, the remainder becomes "0", with the judgment that the selling price of 45 cents is vendible.

The judging functions for the vendibility will be explained more specifically based on the flow-chart of FIGS. 6(*a*) and 6(*b*).

JUDGMENT OF VENDIBILITY

In the present example, description will be made on the automatic vending machine capable of inserting respective coins for 5¢, 10¢, 25¢, 50¢ and $1.00. These coins may be paid out through respective change pipes (not particularly shown), and it is so arranged that even when the number of coins for the change is fewer than ten pieces, if the insertion at the vending is satisfactorily effected, the coins within the inserted number can be paid out as change.

Explanation of Flow-Chart

| Conditions | |
|---|---|
| Sum of inserted coins: | $1.90 (memorized value = 38) |
| Inserted coins: | $1 coin . . . 1, 50¢ coin . . . 1, 25¢ coin . . . 1, 10¢ coin . . . 1, and 5¢ coin . . . 1. |
| Change pipe conditions: | No change for $1, 50¢ and 10¢, and change present for 25¢ and 5¢. |
| Selling price: | 45¢ (selling price numerical value (09)). |
| Memorizing method: | 5¢ is stored as 01, by decimal digit calculation, $1 is stored as 20. |

(1) Under the above conditions, to satisfy the relation "sum of inserted coins ($1.90 (38))—selling price (45¢ (09))>0", the remaining sum of $1.45 (29) is stored in TCBUF, and the judgment is started as to whether or not the remaining sum can be paid out if this vending is effected.

(2) Since TCBUF is sequentially subjected to subtraction by this judgment to alter the contents thereof, the initial remaining sum is stored in TCDBF.

(3) Pointer initial set . . . pointers stored in this register 6 become important memory values for referring to predetermined jump address and table, as pointers for calculating $1.00 at the content 5, 50¢ at the content 4, 25¢ at the content 3, 10¢ at the content 2, and 5¢ at the content 1.

(4) Initially, since 5 ($1) is stored as the content of the pointer R6, the content indicated by fifth data arranged in table 3 is stored in a program counter for jumping.

In the above case, since TBND1$ is written at the fifth row of table 3, the program counter (address) is automatically altered for jumping to TBND1$.

(33) At TBND1$, the required number of coins to be paid out for $1.00 is determined. For this purpose, since the memory unit 5¢ is set as 01, it is not necessary to pay out unless more than 20 is stored for $1.00, and therefore, TCBUF remaining sum of $1.45 (stored remaining sum (29)) is masked by inverted complement data "Eo" for 20 so as to discard data less than 20. Accordingly, 20 is held in the ACC (accumulator) by a logical product of 29 and 20.

(34) Here, by exchanging upper 4 bits with lower 4 bits of the ACC for 20 (00100000), 02 (00000010) is obtained, and a value divided by 10 is held in the ACC.

(35) Since the required number of coins for $1.00 is represented by a value as divided by 20, data is reduced to ½, i.e., 01 (00000001) by shifting 02 (00000010) to the right, and thus, the required number of coins to be paid out for $1.00, i.e., one piece can be prepared for jumping to JUDG4 at step (5).

(5) The one piece for the required number of coins to be paid out as prepared at step (35) is stored in the required number register (CNTRG).

(6) Here, if the required number is "0", the procedure jumps to step 19 for acceleration of the processing speed, but in this case, since the required number is "1", the procedure is shifted to step (7).

(7) In this step, since the value for the pointer R6 for the values arranged in table 4 for detecting the substantial number of inserted coins is 5, and the fifth data CNC1$ means the register address storing the substantial number of 1$ coins inserted, the value of the register pointer is determined at CNC1$.

(8) Since one piece of coin is substantially inserted for $1.00, "01" is stored in CNC1$, and this input number "01" is stored also in the input number buffer register R3.

(9) Here, the input number and the required number of coins are checked for size, and if the input number does not satisfy the required number, the procedure is shifted to step (10) for detection of the state of the change pipe, but in this case, the conditions are satisfied, since one coin is inserted so as to pay out one coin for $1.00, and the procedure is shifted to step (16).

(16) Due to the fact that the number of coins to be paid out is determined as one coin, "01" is stored, in this case, in CNTRG as a paying out number register.

(17) Here, for starting the function to return the number of coins which can be paid out for $1.00, into the sum of money again, the program counter is changed to the value of "pointer R6=5" arranged in table 2, i.e., the fifth data SBST1$ for automatic jumping.

(45) Since "01" is stored in CNTRG as the number of coins which can be paid out for $1.00, the content thereof is stored in the ACC, with the flag being set to "0".

(46) MLT2 means a sub-routine for doubling the value of the ACC.

(58) The value for the ACC is doubled through shifting to the left by one bit, and thus, 01 (00000001) becomes 02 (00000010).

(59) Since the flag is erased at step (45), the procedure proceeds to step (61). (61) This is the step for a decimal conversion when the logic presents a hexadecimal value due to the doubling at step (58).

(47) A sub-routine for computing the stored sum for $1.00 by doubling at step (46) and further by multiplying the value of the ACC by ten (i.e., twenty in total).

(41) The lower 4 bits of the ACC data 02 (00000010) are masked. In other words, "02" is calculated by a logical product of 02 (00000010) and 0F (00001111).

(42) The upper 4 bits and lower 4 bits are exchanged with each other. 02 (00000010) becomes 20 (00100000), and the content of the ACC is increased by 10 times in a decimal value.

(43) Since the flag is erased at step (45), "20" is held in the ACC.

(18) (JUDG7) Here, a difference between the remaining sum and the total value prepared above is obtained. In other words, by step (1), 29 ($1.45) is stored for data of TCBUF, and the difference of 20 ($1.00) prepared this time becomes 29−20=09, and 09 is newly stored in TCBUF.

(19) Owing to "pointer R6=5", the procedure is shifted to step (21).

(21) Here, in the data arranged in table 5, the fifth data is CNCP1$, since the pointer R6 is 5, and thus, the register storing the number of coins which can be paid out for $1.00 is addressed. Accordingly, the value of the register pointer is determined at CNCP1$.

(22) Due to the fact that the number of coins which can be paid out is determined to be 01 in CNTRG at step (16), the content 01 is stored in CNCP1$ selected at step (21).

(23) By the above procedures, the calculation with respect to $1.00 is completed, and 1 is subtracted from the value of the pointer R6 to make the value 4, and the procedure is shifted to the calculation for 50¢.

(24) Since the value for R6 is 4, the calculation is continued, and the procedure is shifted to step (4).

Second Cycle, Explanation of Calculation Flow for 50¢

(4) For the content of R6, 4 (50¢) is stored at the above step (23), with a consequent jumping to TBND50 at the fourth row of table 3.

(36) (DIV10) A sub-routine for reducing the value of TCBUF to 1/10.

(54) Since the stored value becomes 10 when one 50¢ coin is inserted, data less than 10 is discarded. In other words, due to the fact that 09 stored in TCBUF at step (18) is less than 10, the paying out of the 50¢ coin is represented by 00 based on the logical product of 09 (00001001) and F0 (11110000).

(55) The procedure is shifted to step (57) since the ACC is of "0".

(57) The quotient becomes 0 even when 0 is reduced to 1/10.

(5) The required number 0 prepared above is set in CNTRG.

(6) The procedure is shifted to step (19) since the required number of coins is 0.

(19) A judgment for enlarging the range of the vendibility determination by the next 25¢ judgment, since the pointer R6 is 4 (50¢).

In this case, 09 is stored in TCBUF at step (18), and this data is also stored in TCDBF.

(21) In a similar manner as in step 21 described earlier, data CNCP50 at the fourth row of table 5 is set to be the register pointer value for the number of 50¢ coins to be paid out.

(22) Since the number of coins which can be paid out is stored as 00 in CNTRG, the content 00 is stored in CNCP50 designated at step (21).

(23) By the above procedure, the calculation for 50¢ is completed, and 1 is subtracted from the value 4 of the pointer R6 so as to make the value 3.

(24) The calculation is continued, since the value of R6 is 3, and the procedure is shifted to step (4).

Third Cycle, Explanation of Calculation Flow for 25¢

(4) Since 3 (25¢) is stored in R6 at the above step (23), jumping is effected to TBND25 at the third row of table 3.

(37) For 25¢, the stored value is 05 for one coin, and therefore, a quotient is obtained by dividing the value of TCBUF by 5 in order to calculate the required number. This is a sub-routine for first dividing by 10 for the purpose.

(66) The content 09 of TCBUF is held in the ACC.

(55) Since the ACC value is larger than 05, the procedure is shifted to step (56).

(56) The flag is set, and the ACC is masked by "0F". In other words, the ACC, the logical product of 09 "00001001" and mask data "11110000" becomes 00.

(57) The upper 4 bits and the lower 4 bits are exchanged with each other, and the division of 00 by 10 also gives 00.

(38) A sub-routine to effect doubling for reduction into 1/5 as stated in step (37).

(58) The ACC value is 00, and 00 remains to be 00 even when shifting is made toward the left by 1 bit.

(59) Since the flag set at the above step (56) is erected, the procedure is shifted to step (60).

(60) Flag data 01 is added to the content 00 of the ACC. (61) Since the sum at step (60) is 01, the result is also 01 even by the decimal setting.

(5) The required number 01 prepared as above is stored in the required number register CNTRG.

(6) In this case, since the required number is 01, the procedure is shifted to step (7).

(7) Since the value of the pointer R6 of the values arranged in table 4 is 3, the third data CNC25 means the register address storing the substantial number of inserted 25¢ coins, and therefore, the value of the register pointer is designated to CNC25.

(8) In CNC25, 01 is stored due to the fact that one 25¢ coin is substantially inserted, and the input number 01 is also stored in the input number buffer register R3.

(9) Since the input number satisfies the required number, the procedure proceeds to step (16).

(16) The number of coins to be paid out is one piece, and the memory of 01 is held in CNTRG.

(17) The program counter is altered to the value of the pointer R6=3 arranged in table 2, i.e., the third data SBST25 for subsequent jumping.

(50) This is the flow intended to calculate the subtracting value of TCBUF from the required number of 25¢ coins, and in the case of 25¢, since 05 is required for the stored value, the subtracting value is represented by the required number×05. For this purpose, division into ½ is first effected at step (50).

(62) The required number of coins for CNTRG is one piece at 01, and remains to be 01 even by the decimal adjustment.

(63) Since LSB (least significant bit) of the ACC is one, the procedure proceeds to step (64).

(64) The flag is set.

(65) The ACC value is shifted towards the right by 1 bit to be reduced by ½, thus resulting in 00.

(51) Multiplication by 10 here to obtain "the required number×5".

(41) Masking of the lower 4 bits of the ACC data, resulting in 00 in this case. (42) Exchanging of the upper 4 bits with the lower 4 bits for subsequent multiplication by 10. 00 still remains to be 00.

(43) Since the flag is set at step (64), the procedure is shifted to step (44).

(44) The stored value 05 for 25¢ is added to the ACC value 00.

(18) (JUDG7) Here, a difference between the remainder 09 of TCBUF and the total value 05 prepared by the above procedure is obtained. In other words, the result will be represented by 09−05=04, and 04 is newly stored in TCBUF.

(19) Since the pointer R6=3, the procedure proceeds to step (21).

(21) Due to the fact that the pointer R6 is 3 in the data arranged in table 5, the third data CNCP25 is rendered to be the value of the register pointer storing the number of 25¢ coins which can be paid out.

(22) Since the number of coins which can be paid out is determined to be 01 in CNTRG at step (16), the content 01 is caused to be stored in CNCP25 selected at step (21).

(23) The calculation for 25¢ is completed by the foregoing procedures, and 1 is subtracted from the value of the pointer R6 so as to become 2 for shifting to the subsequent calculation for 10¢.

(24) Since the R6 is 2, the calculation is continued. Shifting to step (4).

Fourth Cycle, Explanation of Calculation Flow for 10¢

(4) Since 2 (10¢) is stored as the content of R6 at the above step (23), jumping is effected to the second TBND10 of table 3.

(39) For 10¢, the stored value is 02 for one piece, and therefore, for calculating the required number, a quotient is obtained by dividing the TCBUF value by 2.

(62) Since TCBUF value is 04 by step (18) as described earlier, the value remains to be 04 even upon the decimal adjustment.

(63) Since the LSB of the ACC is 0, the procedure is shifted to step (65).

(65) By shifting the ACC value 04 (00000100) towards the right by 1 bit, 02 is obtained. 02 (00000010).

(5) The required number 02 prepared by the above is stored in the required number register CNTRG.

(6) Since the required number of coins is 02, the procedure is advanced to step (7).

(7) Due to the fact that the value of the pointer R6 in the data arranged in table 4 is 2, the second data CNC10 is memorized as the value of the register pointer storing the substantial number of inserted 10¢ coins.

(8) 01 is stored in CNC10, since one 10¢ coin is inserted, and this input number 01 is caused to be stored also in the input number buffer register R3.

(9) Since the input number 01 does not satisfy the required number 02, the procedure proceeds to step (10) to check the state of the change pipe for 10¢.

(10) The change pipe mask data information arranged in table 1 is selected, and in this case, since the pointer of R6=2, 02 in the second column becomes the mask data for the 10¢ change pipe.

(11) Here, if the logical product of the content of the change pipe information register and the mask data 02 is ∅, no change is present in the change pipe, while if it is 2, presence of change is indicated. In this case, the procedure is advanced to step (15) to make the logical product ∅.

(15) Since the number of coins which can be paid out is 01, although the required number to be paid out is 2, 1 is stored in CNTRG as the number of coins which can be paid out.

(17) The program counter is altered to the value of pointer R6=2 arranged in table 2, i.e., to the second data SBST10 for subsequent jumping.

(52) This is the flow intended to compute the subtracted value of TCBUF from the number of 10¢ coins which can be paid out as calculated above, and in the case of 10¢, since 02 is required for the stored value, the subtracted value is represented by the required number of coins×2. Therefore, the subtracted value becomes 01+01=02 to which the content of CNTRG is added.

(18) (JUDG7) Here, a difference between the remainder 04 of TCBUF and the total value 02 prepared as above is obtained. In other words, the relation is represented by 04−02=02, and 02 is newly stored in TCBUF.

(19) Since the pointer R6=2, the procedure is shifted to step (21).

(21) Due to the fact that the pointer R6 is 2 in the data arranged in table 5, the second data CNCP10 is rendered to be the value of the register pointer for storing the number of 10¢ coins which can be paid out. (22) Since 01 is stored in CNTRG at step (15) for the number of coins which can be paid out, the content 01 is caused to be stored in CNCP10 which is selected at step (21).

(23) By the foregoing procedures, the calculation related to 10¢ is completed, and 1 is subtracted from the value of the pointer R6 so as to make the value 1 for shifting to the subsequent calculation for 5¢.

(24) Since the value of R6 is 1, the calculation is continued. The procedure is shifted to step (4).

Fifth Cycle, Explanation of Calculation Flow for 5¢

(4) Since 1 (5¢) is stored as the content of R6 in the above step (23), jumping is effected to TBND5 in the first row of table 3.

(40) For 5¢, since the stored value is 01 at the standard 1 coin, the value for the required number of coins is the TCBUF data itself, and in this case, 02 becomes the required number.

(5) The required number 02 prepared above is stored in the required number register CNTRG.

(6) Since the required number of coins is 2, the procedure is advanced to step (7).

(7) Owing to the fact that the value of the pointer R6 in the data arranged in table 4 is 1, the first data CNC5 is memorized as the value of the register pointer storing the substantial number of inserted 5¢ coins.

(8) Although 01 is stored in CNC5, since one 5¢ coin is inserted, this input number 01 is stored also in the input number buffer register R3.

(9) Since the input number 01 does not satisfy the necessary number 02, the procedure is shifted to step (10) to check the state of the change pipe for 5¢.

(10) The change pipe mask information arranged in table 1 is selected, and in this case, since the content of the pointer R6 is 1, the first 01 becomes the mask data for the 5¢ change pipe.

(11) Here, if the logical product of the content of the change pipe information register and the mask data 01 is Ø, no change is present in the change pipe, while if it is 1, presence of change is indicated. In this case, the procedure is advanced to step (12), since the logical product becomes 1.

(12) Although the data arranged in table 6 is the maximum number of coins which can be paid out in the presence of change, since the value of the pointer is 01, the first data in table 6, i.e., 10 coins, becomes the data for the maximum number of 5¢ coins which can be paid out.

(13) Here, through addition of the data for the maximum number of 5¢ coins which can be paid out and the input number, the actual number of coins which can be paid out will be 10 coins+1 coin=11 coins.

(14) Here, the required number of coins and the number of coins which can be paid out are compared with each other for size, and in the case where the required number is equal to or smaller than the number which can be paid out, the required number is set in CNTRG, while on the contrary, if the relation is the required number > the number which can be paid out, said number of coins which can be paid out is set in CNTRG.

In the above case, the required number of 5¢ coins is 2 coins, while the number of 5¢ coins which can be paid out is 11 coins, and therefore, the required number of 2 coins is fully sufficient for the purpose, although there is a capacity for 11 coins, and thus, the required number 02 is stored in CNTRG.

(17) The program counter is altered to the value of pointer R6=01 arranged in table 2, i.e., to the first data SBST5 for subsequent jumping.

(53) Here, the content 02 itself of CNTRG prepared above becomes the subtracted value.

(18) (JUDG7) Here, a difference between the remainder 02 of TCBUF and the total value 02 prepared as above is obtained. In other words, the relation is represented by 02−02=0, and "00" is newly stored in TCBUF.

(19) Since the pointer R6=0, the procedure is shifted to step (21).

(21) Due to the fact that the pointer R6 is 1 in the data arranged in table 5, the first data CNCP5 is rendered to be the value of the register pointer for storing the number of 5¢ coins which can be paid out.

(22) Since 02 is stored at step (16) for the number of coins which can be paid out, the content 02 is caused to be stored in CNCP5 which is selected at step (21).

(23) By the foregoing procedures, the calculation related to 5¢ is completed, and 1 is subtracted from the value of the pointer R6 so as to make the value 0.

(24) Since the value of R6 is 0, the calculation flow is completed.

Explanation for Setting and Resetting of Equivalent Column Vendible Flag

(25) In this case, since the value of TCBUF has become 00 at step (18), the procedure is shifted to step (30).

(30) In this judgment, upon completion of the above calculation, when TCBUF is 00, the vendible flag is set at step (31), and if there is any remaining sum in TCBUF, it becomes impossible to pay out, and the procedure is shifted to step (32) so that the vending in the equivalent column can not be effected. In this case, since TCBUF becomes 0, vending is possible for the equivalent column.

(31) This means that the vending is possible.

(32) This means that the vending is impossible.

Explanation of One Example for Particular Judgment of Vendibility

In Japan, since 10 yen is set as a fundamental memory unit 1 for the calculation, memory units become 1/10 with respect to the values of coins such as 5 for 50 yen, 10 for 100 yen, 50 for 500 yen and 100 for 1000 yen, thus inviting no particular problems. However, in the U.S.A., since 5¢ is set as a memory unit 1, other memory units become 1/5 with respect to values of coins such as 2 for 10¢, 5 for 25¢, 10 for 50¢ and 20 for $1.00, and thus, there is a case where the range of vendibility judgment becomes narrow when 25¢ coins are involved. Such an example will be explained with reference to the procedure taken at step (25).

| Conditions | |
|---|---|
| Sum of inserted coins: | 80¢ (memorized value = 16) |
| Inserted coins: | 25¢ coin . . . 2 and 10¢ coin . . . 3 |
| Change pipe conditions: | No change in all change pipes. |
| Selling price: | 50¢ (price value = 10). |

Accordingly, it is judged whether or not the memorized value 16−10=6 can be paid out as change.

Under the above conditions, steps proceed according to the numbers in the flow-charts described earlier.

| | |
|---|---|
| $1.00 | (1)→(2)→(3)→(4)→(33)→(34)→(35)→(5)→(6)→(19)→(21)→(22)→(23)→(24) |
| 50¢ | (4)→(36) sub-routine omitted→(5)→(6)→(19)→(20)→(21)→(22)→(23)→(24) |
| 25¢ | (4)→(37)→(38)→(5)→(6)→(7)→(8)→(9)→(16)→(17)→(50)→(51)→(18)→(19)→(21)→(22)→(23)→(24) |
| 10¢ | (4)→(39)→(5)→(6)→(19)→(21)→(22)→(23)→(24) |
| 5¢ | (4)→(40)→(5)→(6)→(7)→(8)→(9)→(10)→(11)→(15)→(17)→(53)→(18)→(19)→(21)→(22)→(23)→(24) |

(25) Here, since TCBUF is arranged to pay out the larger value coins with priority, 25¢ (memorized value=5) is first subtracted from the remaining sum of 30¢ (memorized value=6) undesirably, and therefore, 5¢ which can not be paid out remains (memorized value=1), thus making it impossible to effect the vending in the Japanese system.

According to the present invention, there is provided such a flow that, at step (25), the number of 25¢ coins to be paid out is subtracted only in the presence of the number of 25¢ coins, with a remaining sum of 5¢, and based on the content of TCDBF stored at step (20), judgment is made again as to whether or not the paying out can be effected by 5¢ and 10¢ coins as follows.

(25) In this case, since TCBUF is 01, the procedure is shifted to step (26).

(26) Since the paying out by one coin is scheduled for CNCP25, 01 is stored.

(27) The remaining 30¢ (memorized value=6) prepared at step (20) is returned to be stored in TCBUF.

(28) 1 is subtracted from the value 01 of CNCP25, and accordingly, CNTRG becomes 00.

(29) 3 is set in the pointer R6 as pointer sub-initial.

Subsequently, the numbers of the flow-chart are employed for the explanation,

| | |
|---|---|
| 25¢ | (21)→(22)→(23)→(24) |
| 10¢ | (4)→(39)→(5)→(6)→(7)→(8)→(9)→(16)→(17)→(52)→(18)→(19)→(21)→(22)→(23)→(24) |
| 5¢ | (4)→(40)→(5)→(6)→(19)→(21)→(22)→(23)→(24) |

and thus, the procedure is completed.

Since TCBUF at step (25) becomes 00 at step (18) of the flow for 10¢, the procedures are subsequently advanced as in (30)→(31), thus making the equivalent column vendible.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. In an automatic vending machine capable of paying out change through combinations of a plurality of denominations of coins in which at least one denomination of coin is a non-integral multiple of a value of coins of a lower denomination, a control arrangement for determining the vendability of a commodity selected by a customer by utilizing the value and denominations of inserted and stored coins prior to effecting the purchase of the commodity by the customer, said control arrangement comprising:

price memory means for preliminary storing selling prices of commodities;

means for calculating a sum of change required to be paid out for each commodity which may be sold, by subtracting the selling price of the selected commodity from said value of the inserted coins;

a register for first holding the required sum of change for each commodity upon calculation of said sum by said sum of change calculating means;

calculating means for reading out the sum of change from said register, determining the number of coins of a certain denomination to be paid out as part of said sum of change, subtracting a sum equivalent to the number of said coins of a certain denomination from said sum of change, and loading the result of the subtraction into said register;

said calculating means including dividing means for determining the number of coins of a denomination required to be paid out by dividing the content of said register by a value of coins of said denomination;

means for detecting the presence or absence of change in a change coin stocking section provided for each denomination of coin;

inserted coin number detecting means for counting the number of coins of each denomination inserted by the customer in one vending transaction;

means for judging the number of coins of each denomination which can be paid out according to the presence or absence of the inserted coins and the change in said change coin stocking section;

comparing means for determining the number of coins to be paid out, by comparing said required number of coins with the number of coins which can be paid out, and selecting the smaller number;

sequence control means for controlling the operation of said calculating means by using a larger denomination coin priority to subtract the sum corresponding to said number of coins of a denomination paid out from the content of said register each time the number of coins of a certain denomination to be paid out is determined;

means for detecting whether or not the content of the register is "0";

correcting means for controlling said comparing means such that for the final result of the subtraction by said calculating means, if the content of said register does not become "0", one coin is subtracted from the number of the larger denomination coins to be paid out, to correct the required number of lower denomination coins to be paid out;

judging means for judging the selected commodity at its selling price as vendable if the content of said register becomes "0" through subtraction, and for judging said selected commodity at its selling price as not vendable, if the content of said register does not become "0" after correcting the required number of coins of a lower denomination to be paid out; and a plurality of vendable commodity indicators each corresponding to a commodity in said machine for indicating whether a selected commodity has been judged as vendable by said judging means.

2. A control arrangement for an automatic vending machine as claimed in claim 1, wherein said means for detecting the presence or absence of change in the respective change coin stocking sections detects the presence or absence of change in each section with respect to a reference number of coins, the total of said reference number of coins and the number of inserted coins with respect to the same denomination being judged as said number of coins which can be paid out upon detecting the presence of change in a respective coin stocking section.

3. A method, in an automatic vending machine containing various selectable commodities, for determining the vendability of a selected commodity by comparing the price value of the selected commodity with the total value of the coins inserted into the vending machine and determining if said vending machine is capable of paying out the proper change through combinations of a plurality of denominations of coins, said method comprising the steps of:

(a) detecting a number of, and value for, each of a plurality of coins inserted into the vending machine;

(b) determining and storing a total summation value of the values of said coins inserted into the vending machine;

(c) storing a total number of each of a plurality of various denominations of coins stored in said vending machine;

(d) adding said total number of coins stored in said vending machine, to said number of coins inserted into said vending machine, for each of a plurality of coin denominations, to determine and store the total number of coins available, for each of a plurality of coin denominations, to be dispensed as change;

(e) determining which of said various selectable commodities has been selected and storing its corresponding price value;

(f) determining the vendability of said selected commodity by utilizing a larger denomination coin priority method including the steps of, (1) subtracting said price value from said total summation value to determine a total value of change needed to be paid out;

(2) dividing said total value of change to be paid out by a largest coin denomination remaining which said vending machine can pay out to arrive at a resultant value;

(3) subtracting said resultant value from said stored total number of coins available, for said largest coin denomination remaining, and determining a number of coins, of that particular coin denomination, which may be paid out as change;

(4) multiplying the value of that particular coin denomination by said number of coins determined, to arrive at an intermediate value, (5) subtracting said intermediate value from said total value of change to be paid out to arrive at a total value of change remaining to be paid out;

(6) repeating steps 2–5 for each successively lower coin denomination value remaining in said vending machine;

(7) detecting when said total value of change remaining to be paid out becomes "0";

(8) upon repeating steps 2–5 for each successively lower coin denomination remaining and detecting that said total value of change remaining does not become "0", one coin is subtracted from the number of larger denomination coins to be paid out as change, to correct the required number of lower denomination coins to be paid out, and steps 2–5 are repeated;

(g) judging said selected commodity as being vendable if said total value of change remaining to be paid out equals "0", and judging said selected commodity as not vendable if said total value of change remaining to be paid out does not equal "0";

(h) indicating whether a selected commodity has been judged vendable by lighting of an indicating means corresponding to said selected commodity.

* * * * *